US006648132B1

(12) United States Patent
Smouha

(10) Patent No.: US 6,648,132 B1
(45) Date of Patent: Nov. 18, 2003

(54) DISPLAY CASE

(75) Inventor: Joseph Smouha, New York, NY (US)

(73) Assignee: A Classic Time Watch Co., Inc., New York, NY (US)

( * ) Notice: Subject to any disclaimer, the term of this patent is extended or adjusted under 35 U.S.C. 154(b) by 0 days.

(21) Appl. No.: 09/696,420

(22) Filed: Oct. 25, 2000

(51) Int. Cl.[7] ..... A45C 11/04
(52) U.S. Cl. ..... 206/6.1; 206/301; 206/806
(58) Field of Search ..... 206/6.1, 806, 804, 206/776, 781, 301, 497, 490, 775; 215/10; D9/415, 418; D20/20

(56) References Cited

U.S. PATENT DOCUMENTS 4,396,121 A * 8/1983 Lemmon ..... 206/566
4,429,798 A * 2/1984 Borows ..... 215/10
4,726,469 A * 2/1988 Farber ..... 206/493
4,873,193 A * 10/1989 Jensen et al. ..... 215/10
5,117,971 A * 6/1992 Fisher ..... 206/6.1
5,168,985 A * 12/1992 Shih ..... 206/6.1
5,487,600 A * 1/1996 Griffin ..... 312/305
5,509,528 A * 4/1996 Weisburn ..... 206/308.1
D370,372 S * 6/1996 Kraft ..... D6/470
D378,057 S * 2/1997 Dikowitz ..... 206/6.1
6,085,927 A * 7/2000 Kusz ..... 220/23.87

* cited by examiner

*Primary Examiner*—Shian Luong
(74) *Attorney, Agent, or Firm*—Bernard Malina; Malina & Wolson

(57) ABSTRACT

A display case is provided for a personal accessory item such as jewelry, eyeglasses and wrist watches. The case includes a display support for vertically suspending the accessory item, an inner tube surrounding the display support, an outer tube within which the inner tube nests, and a cover positioned over an open end of the outer tube. All the walls of the display case are constructed of transparent plastic. A fluid, particularly colored water, may be positioned in a volume of space separating inner from outer tubes. The display case may stand upright upon a flat outer surface of the cover or may be hung via a mount from a wall.

8 Claims, 2 Drawing Sheets

FIG.1
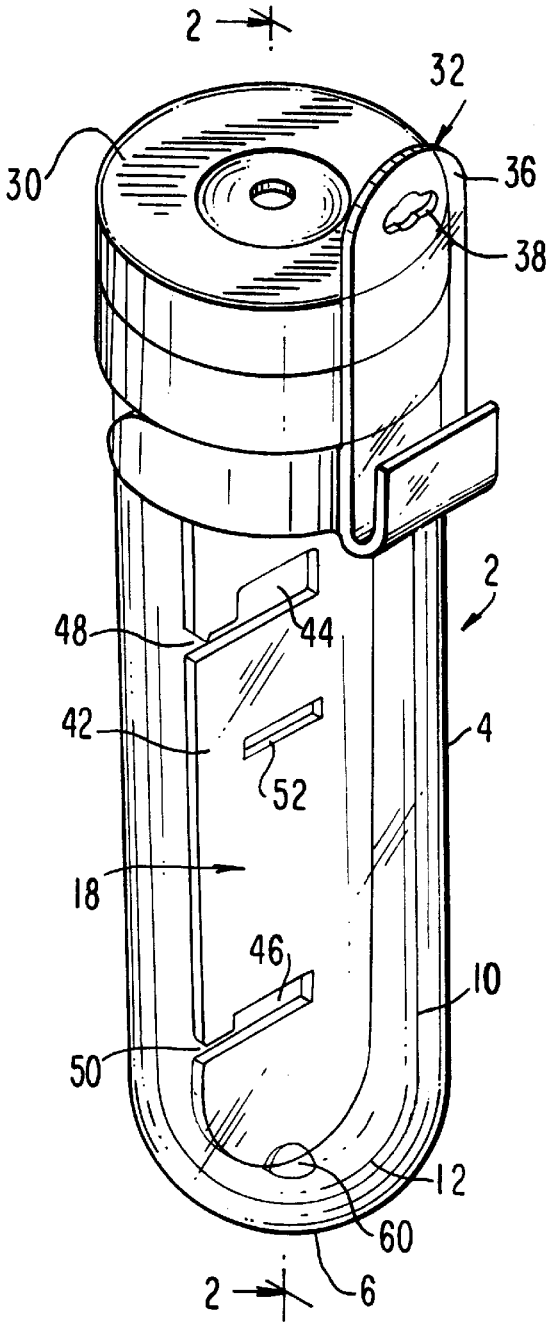
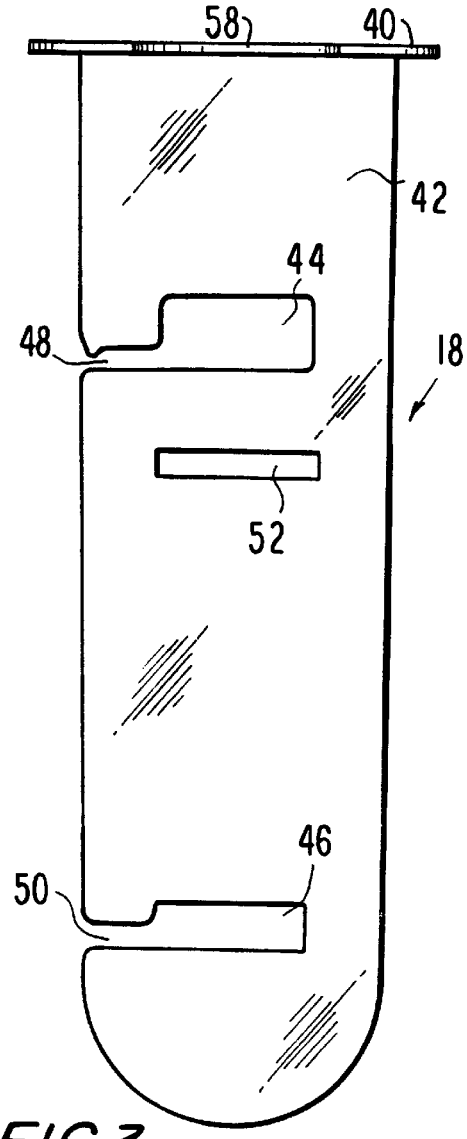
FIG.3
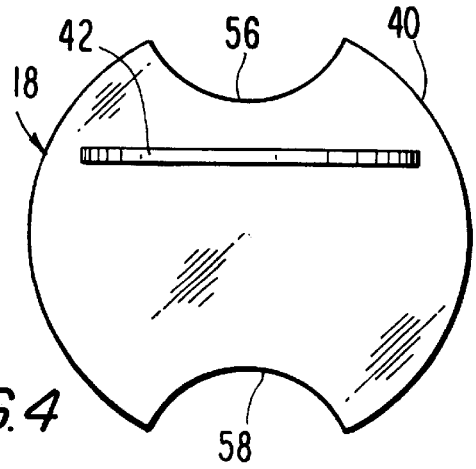
FIG.4

DISPLAY CASE

BACKGROUND OF THE INVENTION

1. Field of the Invention

The invention concerns a display case for small personal accessory items such as jewelry, eyeglasses and timepieces presented in a way to attract a customer's interest.

2. The Related Art

Display containers for small personal accessories come in many varieties. They may possess one or more functionalities. A case must be protective of the item yet allow the potential customer adequate view for examination. The fuller the view the better, especially for an attractive item.

An elegant case often enhances the sale price of the item. Packaging sets the tone for increasing the value of an otherwise ordinary article. Presentation can be a deciding edge in any sale.

Retailers seek to draw-in the customer. An unusual display case, perhaps even an unconventional one, may draw attention. Without grabbing attention, a retailer must depend only on advertising the price to achieve the sale.

Jewelry, eyeglasses and watches generally are sold in uninteresting display packaging. In those instances where a packaging case has an elegant construction, it may not be sufficiently unusual to grab attention.

Accordingly, it is an object of the present invention to provide a display case for a personal accessory item which allows a customer an unimpeded view of at least most of the item.

Another object of the present invention is to provide a display case for a personal accessory item which draws attention from potential customers.

Yet another object of the present invention is to provide a display case for a personal accessory item from which the item can readily be removed and returned without damaging the case.

SUMMARY OF THE INVENTION

A display case is provided for a personal accessory item which includes:

- a cylindrical outer tube with a round closed end and an open end;
- a cylindrical inner tube with a round closed end and an open end nested within the outer tube, a volume of space separating inner from outer tubes;
- a display support formed with at least one aperture for vertically suspending the accessory item along at least a partial length of the inner tube, the support being suspended from the open end of the inner tube; and
- a cover positioned over the open end of the outer tube.

Illustrative but not limiting of the personal accessory items are jewelry, eyeglasses (particularly sunglasses), and timepieces (particularly wrist watches).

Walls of the outer and inner tubes are light transparent to allow viewing of the personal accessory items. Preferably, the display support is also constructed of a light transparent material thereby allowing a viewer to inspect both front and rear aspects of the displayed item. Light transparent materials of construction may either be glass or plastic, with the latter preferred because of its lighter weight and resistance to breakage. Suitable plastics include polymethylmethacrylate, polyvinylchloride and polyethyleneterephthalate. Construction walls ordinarily are colorless but may also be tinted with a color. Artistic interest may be enhanced through a preferred embodiment which fills with fluid the volume of space between inner and outer tubes. Water is the fluid of choice but could be substituted by organic liquids, including glycols, monohydric alcohols, esters, ketones and any combinations thereof.

An important element of the present invention is that of display support. It includes an anchor plate and a tongue in perpendicular arrangement to one another. The tongue has a surface oriented in a plane parallel to a longitudinal axis that traverses a length of the inner tube. The plane of the tongue surface is eccentrically displaced from a center of the inner tube. A span of the plate is preferably at least as large as a cross-sectional diameter of the inner tube. This allows the plate to be supported by a circumferential lip defining the open end of the inner tube.

A positioning finger projects outwardly from an interior surface of the closed end of the inner tube. The finger serves as an orienting detent allowing the tongue of the display support to be properly positioned within the inner tube.

BRIEF DESCRIPTION OF THE DRAWINGS

Further objects, features and advantages of the present invention will become more readily apparent from consideration of the following drawing in which:

FIG. 1 is a perspective view of the display case with a hanger attached thereto.

FIG. 3 is a front view of the display support component intended for suspension within the inner tube; and FIG. 4 is a top plan view of the display support shown in FIG. 3.

DETAILED DESCRIPTION OF THE INVENTION

Figure 2:
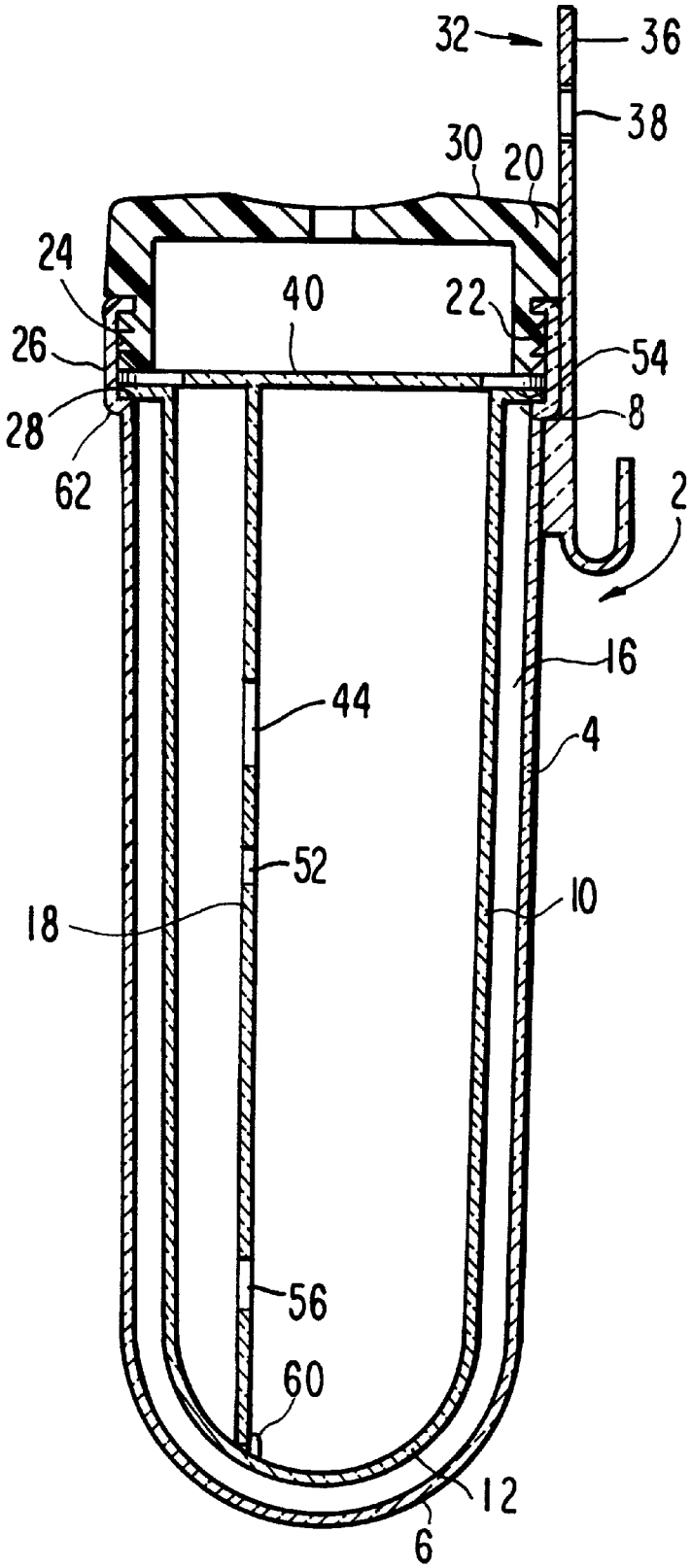
FIG. 2 is a cross-sectional view along the line 2—2 of FIG. 1 of the perspective view gripping the outer tube.

Now there has been developed a display case capable of being hangable or freely-standing. Personal accessory items can be mounted therein for unobstructed view by potential customers. Moreover, the case is highly eye-catching to any casual observer. Visual impact can further be improved by supplying a fluid, especially a colored liquid, within the space separating inner from outer tubes. The unusualness of this display arrangement increases customer awareness, accessory item selling price and volume of sales.

FIG. 1 details a preferred embodiment of a display case 2 wherein a personal accessory item may be suspended for viewing. The case includes a cylindrical outer tube 4 having a rounded, closed end 6 and an open end 8. Concentrically within the outer tube is a cylindrical inner tube 10 which also possesses a round, closed end 12 and an open end 14. Between inner and outer tubes is a volume of space 16.

Vertically suspending an accessory item is a display support 18. A cover 20 is positioned over the open end of the outer tube. Slightly deflectable circumferential ribs 22 are formed on a lower outer wall of the cover. These ribs sealingly engage interior walls 24 of a cup 26 positioned across the open end 8 of the outer tube. Circumferential ledge 28 joins in unitary fashion the cup to the outer tube, the cup having a larger diameter than the outer tube.

The display case may be placed in an erect position by standing the case on its head whereby a flat upper surface 30 of the cover 20 is in contact with a flat exterior surface. Alternatively, the display case may be hung from a wall or other supportive device. In this alternative mode, a mount 32 with curvilinear arms 34 are clipped around the outer tube. Walls of the outer tube taper very slightly towards closed end 6. The slight taper allows arms 34 to easily slip around the outer tube near the closed end while gaining a tighter grip as the arms slide toward the open end 8. Finally, the arms are arrested from any further upward movement by an undersurface 62 of ledge 28. The mount includes a bracket 36 unitarily molded with the arms projecting upward toward the cover. Slot 38 is formed near an upper end of the bracket serving as an engageable member for hanging over a nail or other finger-like projection anchored in a room wall.

FIG. 2 provides a front face view of the display support 18. An anchor plate 40 is attached adhesively in perpendicular arrangement to a tongue 42. All parts of the display support are formed of a transparent plastic. A pair of slits 44, 46 are positioned along a length of the tongue. Grooves 48, 50 allow lateral access of a wrist watch (or other personal accessory item) to the pair of slits. These grooves fasten the wrist watch against the tongue for display purposes. An additional slit 52, without lateral access, is formed in the tongue as an optional suspension point.

FIG. 3 provides a best view of the anchor plate 40. This plate has a round configuration of a diameter sufficient to be supported on a lip 54 surrounding the open end 14 of the inner tube. A pair of semi-circular notches 56, 58 are cut into the plate. These notches are of a size sufficient for inserting a person's finger in each so that the display support may be lifted from within the inner tube. As best seen in FIG. 3, the tongue 42 is eccentrically displaced from a center of the anchor plate, and thereby also from a center of the inner tube. Positioning of the tongue is secured by a finger 60 projecting upwardly from an interior surface of a closed end of the inner tube. The tongue as best seen in FIG. 1 has a major surface oriented in a plane parallel to a longitudinal axis (L) that traverses a length of the inner tube.

Assembly of the display case is done in the following manner. An accessory item, such as a wrist watch, is suspended between grooves 48, 50 of tongue 42. The display support 18 is then inserted into the inner tube 10. Anchor plate 40 is allowed to be seated on lip 54. Colored water is poured into the outer tube in an amount sufficient to fill the space between inner and outer tubes when nested one within another. An undersurface of the lip 54 is seated for support on ledge 28. Thereafter, cover 20 is tightly placed within cup 26 forming a water-tight seal. The display case is now assembled and can be shown in one of two alternate modes. The first mode arranges the case to be stood upon its cover surface 30. In this arrangement, the rounded end of the outer tube 4 projects upwardly from a surface upon which the case rests.

The second mode is a hanging display arrangement. A mount 32 is slid around the outer tube 4 beginning at the closed end and moving toward the open end. This results in arms 34 tightly gripping the outer tube and to being supported against further slippage by a protruding undersurface 62 of the cup 26.

Additional advantages and modifications will readily occur to those skilled in the art. Therefore, the invention, in its broader aspects, is not limited to the specific details and representative configurations described herein. Accordingly, various modifications may be made without departing from the spirit and scope of the general inventive concept as defined by the appended claims and their equivalents.

What is claimed is:

1. A display case for a personal case accessory item comprising:

a cylindrical outer tube with a round closed end and an open end;

a cylindrical inner tube with a round closed end and an open end nested within the outer tube, a volume of space filled with fluid separating the inner from the outer tube;

a display support formed with at least one aperture for vertically suspending the accessory item along at least a partial length of the inner tube, the support being suspended from the open end of the inner tube; and a cover positioned over the open end of the outer tube.

2. The case according to claim 1 wherein walls of the outer and inner tubes are light transparent.

3. The case according to claim 2 wherein walls of the display support are light transparent.

4. The case according to claim 2 wherein the transparent walls are tinted with a color.

5. The case according to claim 1 wherein the fluid is water.

6. The case according to claim 1 wherein the fluid is colored.

7. A display case for a personal accessory item comprising:

a cylindrical outer tube with a round closed end and an open end;

a cylindrical inner tube with a round closed end and an open end nested within the outer tube, a volume of space separating the inner from the outer tubes;

a display support formed with at least one aperture for vertically suspending the accessory item along at least a partial length of the inner tube, the support comprising an anchor plate and a tongue in perpendicular arrangement said support being suspended from the open end of the inner tube;

a positioning finger projecting upwardly from an interior surface of the closed end of the inner tube; and a cover positioned over the open end of the outer tube.

8. The case according to claim 7 wherein the plate is supported by a circumferential lip defining an open end of the inner tube.

* * * * *